US005660159A

United States Patent [19]

Clayton

[11] Patent Number: 5,660,159

[45] Date of Patent: Aug. 26, 1997

[54] AIRGUN WITH ROTARY ACTUATOR

[76] Inventor: Richard A. Clayton, 10200 Hillview Ave., Chatsworth, Calif. 91311

[21] Appl. No.: 388,399

[22] Filed: Feb. 14, 1995

Related U.S. Application Data

[63] Continuation-in-part of Ser. No. 15,137, Feb. 9, 1993, Pat. No. 5,522,374, which is a continuation-in-part of Ser. No. 793,186, Nov. 18, 1991, Pat. No. 5,186,156.

[51] Int. Cl.[6] ..... F41B 11/14; F41B 11/18

[52] U.S. Cl. ..... 124/66; 124/59

[58] Field of Search ..... 124/45, 48, 51.1, 124/65, 66, 67, 82, 59

[56] References Cited

U.S. PATENT DOCUMENTS

| | | | |
|---|---|---|---|
| 1,478,597 | 12/1923 | Bebler | 124/59 |
| 1,691,170 | 11/1928 | Schmidt | 124/66 |
| 2,149,749 | 3/1939 | Savage | 124/65 X |
| 2,237,678 | 4/1941 | Lohr et al. | 124/66 |
| 2,434,436 | 1/1948 | Rochowiak | 124/67 X |
| 2,437,727 | 3/1948 | Drumheller | 124/82 X |
| 4,848,307 | 7/1989 | Tsao | 124/59 |
| 4,986,251 | 1/1991 | Lilley | 124/67 |

FOREIGN PATENT DOCUMENTS

| | | | |
|---|---|---|---|
| 166759 | 7/1921 | United Kingdom | 124/67 |

*Primary Examiner*—John A. Ricci

*Attorney, Agent, or Firm*—Blakely, Sokoloff, Taylor & Zafman

[57] ABSTRACT

A multi-shot airgun employs a hand crank for cocking and firing of an air pump, and advancement of a multi-projectile magazine. Turning the crank causes the pump's plunger to be cycled back and forth to cock and discharge the pump. Turning the crank additionally actuates a projectile advancement mechanism. The advancement mechanism sequentially positions a plurality of projectiles in firing alignment with an air discharge port of the pump. Continuous rotation of the crank results in discharge of the projectiles in rapid succession. A high capacity magazine is provided in the form of a long, continuously looped ammunition belt to allow extended firing time between loadings.

33 Claims, 6 Drawing Sheets

AIRGUN WITH ROTARY ACTUATOR

This is a continuation-in-part of application Ser. No. 08/015,137 filed Feb. 9, 1993, now U.S. Pat. No. 5,522,374, which is a continuation-in-part of application Ser. No. 07/793,186 filed Nov. 18, 1993, now U.S. Pat. No. 5,186,156. The specification of said issued patent is incorporated herein by reference. This application relates to information contained in Invention Disclosure Document No. 335,946 filed Jul. 26, 1993.

BACKGROUND OF THE INVENTION

The present invention relates to mechanical guns and more particularly to air operated guns with repeating capability.

Various airguns are known in the art in which a magazine comprising a plurality of launching tubes is moved relative to a compressed air outlet to sequentially align a plurality of projectiles for launch from a single air pump comprising a plunger and air chamber contained by the gun. Examples are found in U.S. Pat. No. 2,237,678 (Lohr et al), U.S. Pat. No. 3,540,426 (Lohr et al), U.S. Pat. No. 3,913,553 (Braughler et al), U.S. Pat. No. 4,841,655 (Ferri), and U.S. Pat. No. 4,848,307 (Tsao). These references all disclose cocking actuators, for drawing the plunger rearward in preparation for firing, comprising either a handle manually driven through a linear sliding motion, or a pivoted lever which is manually driven through a semi-circular arc. In all cases the actuating member of the cocking mechanism reciprocates through a forward stroke and a reverse stroke in each cycle of operation (where a cycle of operation corresponds to one complete firing and advancement of the gun). None of the cited references employs or suggests the use of a rotary actuator for cocking the airpump, wherein the actuator may be driven continuously in a single direction for a complete cycle of operation or multiple cycles.

Pneumatically discharged guns utilizing rotary hand crank mechanisms are disclosed in U.S. Pat. No. 399,882 (Graydon) and U.S. Pat. No. 1,478,597 (Bebler). However, neither gun utilizes the hand crank to cock or release a plunger, or in any other way to cause air to be compressed. Instead, both use the hand crank to open valves allowing pressurized air to flow from precharged reservoirs.

Numerous prior art references may be found in which a toy machine gun ejects projectiles by utilizing a crank mechanism to cock and release a hammer or firing pin that strikes the projectiles directly. The following U.S. Patents disclose mechanisms of this type: U.S. Pat. No. 511,069 (Brown), U.S. Pat. No. 1,328,929 (McDaniel), U.S. Pat. No. 1,353,696 (Abramowitz), U.S. Pat. No. 1,360,410 (Jones), U.S. Pat. No. 2,371,249 (Majewski), U.S. Pat. No. 2,434,436 (Rochowaik), U.S. Pat. No. 2,836,167 (Saito), U.S. Pat. No. 4,241,716 (Tsui) and U.S. Pat. No. 4,834,058 (Gegere). None of these suggest the use of an air pump or air pressure for discharging projectiles. With the exception of Saito, which takes the form of a pistol, the devices disclosed are either supported by tripods and equivalent structures, or are provided with a rifle stock and a downwardly depending forward handle.

Crank operated liquid pumping devices, including one which stores crank energy in a torsion spring, are disclosed in U.S. Pat. No. 2,746,643 (Spalding).

Air guns which employ an elongated nozzle extension to move projectiles from a magazine to a single launching barrel are disclosed in U.S. Pat. No. 3,818,887 (Akiyama) and U.S. Pat. No. 4,986,251 (Lilley).

SUMMARY OF THE INVENTION

The present invention provides a new construction for air powered guns and projectile launchers wherein a rotary actuator such as a hand crank mechanism is employed to cock the plunger of an airpump. The crank may also be employed, through various linkages, to advance the magazine of such a gun so that a fresh projectile is shuttled into firing alignment in cooperation with each cycle of the plunger.

In a preferred embodiment of the invention, a rotary hand crank is employed to advance and fire projectiles from a magazine in a toy machine gun. The magazine comprises a plurality of barrels joined to one another by a flexible belt. The hand crank turns a cam wheel having a plurality of paddle-like lobes symmetrically spaced about the rotational axis of the crank. The lobes sequentially engage a flange protruding from the plunger of an air pump, to draw back and release the plunger multiple times for each 360° rotation of the hand crank. The plunger is forward biased by a compression spring so that each time it is released by a lobe it is propelled forwardly to discharge compressed air from the air pump, for the purpose of expelling a projectile from a barrel in firing alignment.

The plunger of the above embodiment further comprises a member which cooperates with a magazine advancing mechanism. Travel of the plunger drives the mechanism to move the magazine through a range of motion sufficient to remove one barrel from firing alignment with the air pump discharge port, and to place another barrel into alignment. More particularly, linear travel of the plunger is translated into rotation of a set of sprockets which carry and propel the belt type magazine.

The preferred embodiment further comprises a system of handles which overcome problems related to aiming the gun while operating the hand crank.

Thus it is a primary objective of the present invention to construct a novel multiple shot air gun with a rotary cocking mechanism.

It is further among the objectives of the present invention to provide a novel air gun in which a rotary crank mechanism cocks and fires an air pump and simultaneously advances a multi-projectile magazine.

Another objective of the present invention is to provide a novel system of handles which makes the use of a hand crank operationally convenient and comfortable in a hand held airgun.

DETAILED DESCRIPTION OF THE INVENTION

Figure 1:
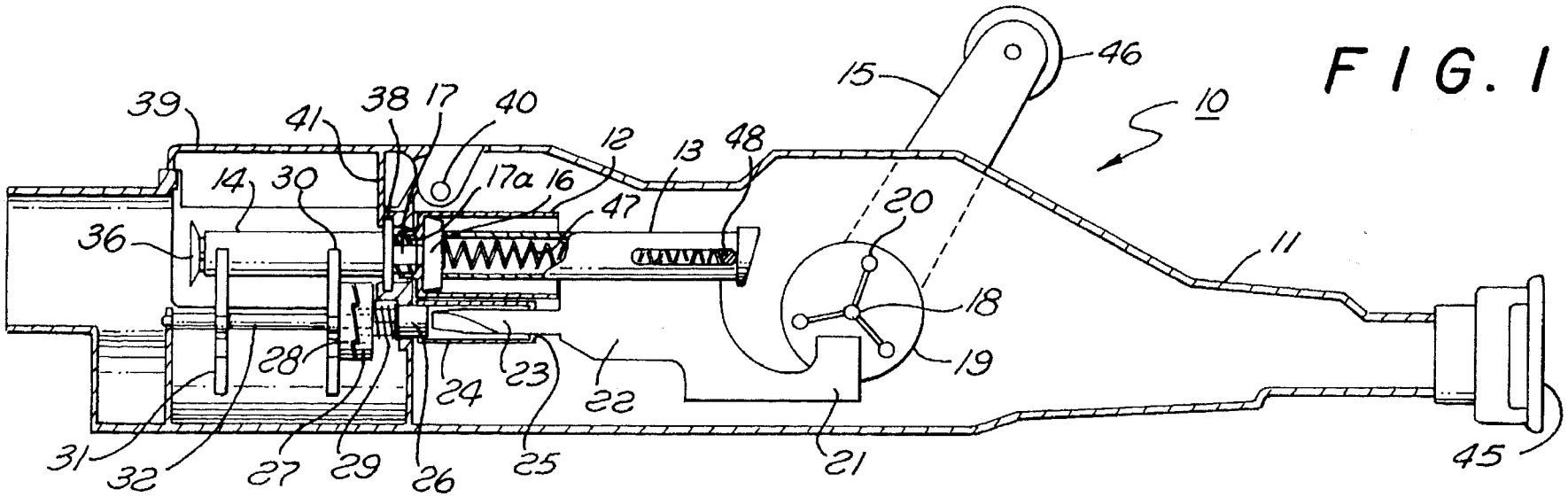
FIG. 1 is a side view in partial cross-section of a toy air gun according to the present invention.
Figure 2:
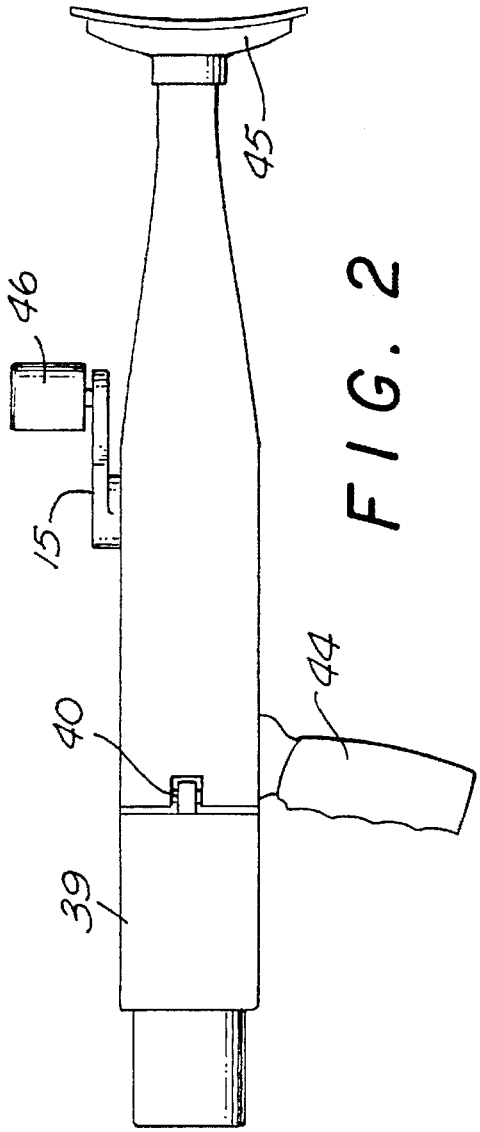
FIG. 2 is top view of the gun shown in FIG. 1.

FIG. 1 depicts by way of illustration but not of limitation an air operated gun 10 of the present invention which comprises a frame 11, a cylindrical air chamber 12, a plunger 13, a projectile magazine 14 and a hand crank 15. The plunger 13 comprises a piston 16 which fits in chamber 12 and is able to travel back and forth to compress air within chamber 12 so as to discharge air under pressure through a nozzle or discharge port 17. The hand crank 15 is rigidly joined to a plunger driving cam wheel 19 for rotation about an axis at the cam's center 18 so that rotation of the crank forces rotation of the cam. Three lobes 20 protrude from the cam. The lobes are adapted to engage a hook 21 on an appendage 22 of the plunger 13. With respect to FIG. 1, counter-clockwise rotation of the crank will cause the lobes to successively cock the plunger by drawing it rearward against the bias of a firing spring 47 (rearward being to the right in FIGS. 1 and 2). As the cam continues to rotate, the; plunger will reach its fully cocked position and the lobe will become disengaged. Spring 47 will drive the plunger forward through a firing stroke, to discharge a projectile and position the plunger for engagement with the next cam lobe. Since there are three lobes on cam 19, each full revolution of the crank will result in the plunger being cycled three times.

The term "cocked position" is used herein to describe a position of plunger 13 or equivalent air compression device where it is moved in preparation for discharging air from chamber 12 or equivalent air pump. For the embodiments shown and described herein, the cocked position refers generally to a rearward displacement of the plunger in preparation for propulsion to a forward discharged position. The cocked position may be a latched position awaiting release by a trigger, or it may be a transitory position of a fully automatic firing mechanism. Generally speaking, the plunger is moved to its cocked position by means of energy transferred from manual operation of a hand crank.

Figure 5:
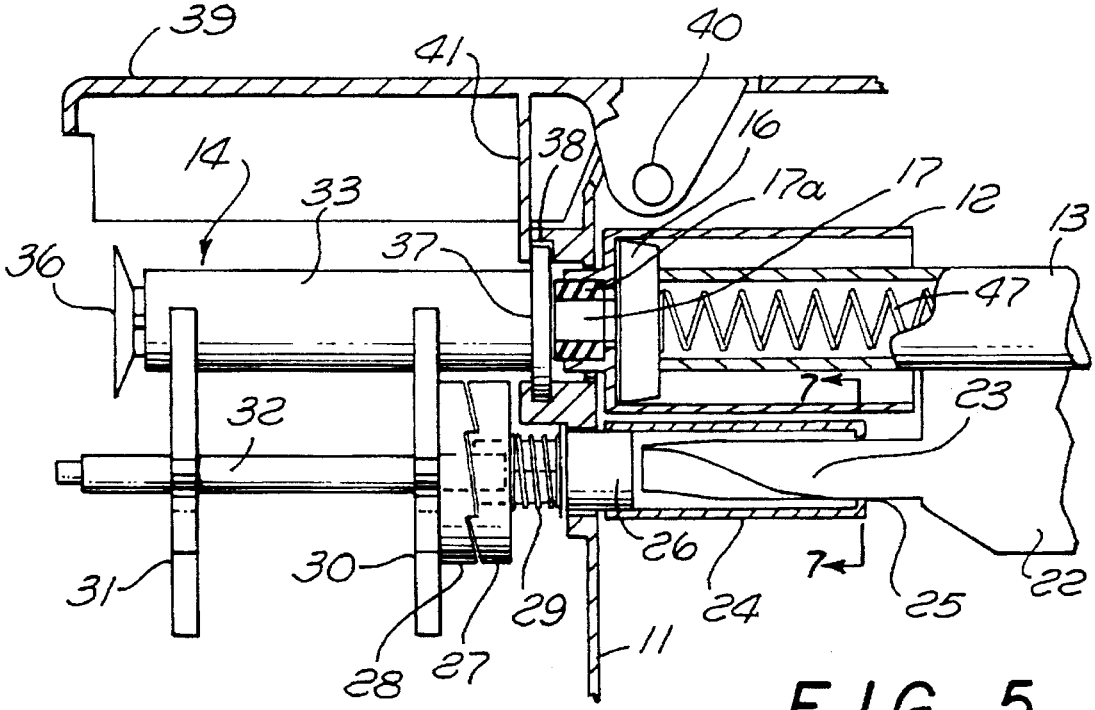
FIG. 5 is an enlargement of a portion of the gun as shown in FIG. 1.
Figure 7:
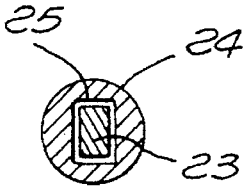
FIG. 7 is a rear cross-sectional view of magazine advancing components taken in the direction of arrows 7—7 of FIG. 5.

The plunger appendage 22 further comprises a magazine advancement member 23. Member 23 interfaces with a magazine advancing mechanism which comprises a cylinder 24 having a rectangular opening 25 on its rearward end, a drive shaft 26 and a pair of ratcheting clutch plates 27 and 28. These features may be better viewed in the enlarged detail of FIG. 5. The plunger's magazine advancement member 23 comprises a rectangular cross section complementary in shape to the opening 25 (see FIG. 7), and is twisted along its length by approximately 60 degrees. As the plunger is drawn rearwardly during a cocking operation, member 23 is drawn through opening 25, forcing opening 25, and hence cylinder 24, to rotate according to the degree of twist of member 23. Thus a full rearward stroke of the plunger will rotate the cylinder 24 through approximately 60°, or one sixth of a revolution. Note that a forward stoke of the plunger will have the same effect. The cylinder 24 and drive shaft 26 are mutually keyed so the drive shaft rotates with the cylinder. A forward portion of the drive shaft is formed with a hexagonal cross section. The driving clutch plate 27 is slidingly carried on this forward portion of drive shaft 26 and is hexagonally keyed to match so that rotation of the drive shaft 26 also forces rotation of clutch plate 27. A spring 29 biases the driving clutch plate 27 into engagement with the driven clutch plate 28, so that when plate 27 rotates in a direction in which the teeth of the plates 27 and 28 engage, plate 28 will also be forced to rotate. When plate 27 rotates in the opposite direction, the sloped surfaces of the two clutch plates will slide past one another without forcing rotation of plate 28. The clutch plates are configured for driving engagement to correspond to a rearward stoke of the plunger 13, and for a forward stroke of the plunger to correspond to a sliding, non-engaged "reset" operation of the drive clutch 27. Thus, as the plunger 13 is cycled back and forth, the cylinder 24, drive shaft 26 and drive clutch 27 will reciprocally travel back and forth through a 60° rotary arc, while the driven clutch plate 28 will step in a single direction by 60°.

Figure 3:
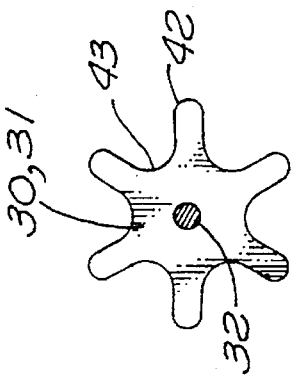
FIG. 3 is a front view of a magazine advancing sprocket from the gun of FIG. 1.
Figure 4:
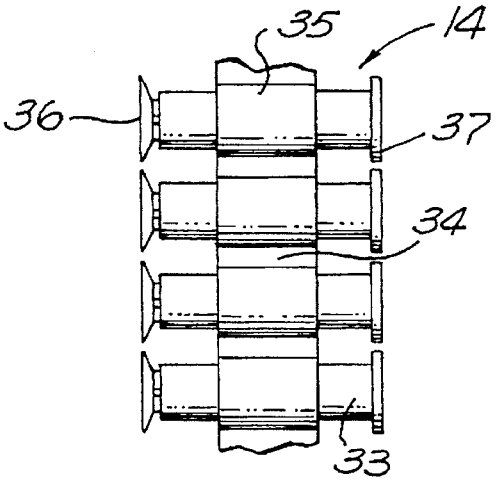
FIG. 4 is a side view of a portion of a projectile magazine used with the gun of FIG. 1.
Figure 6:
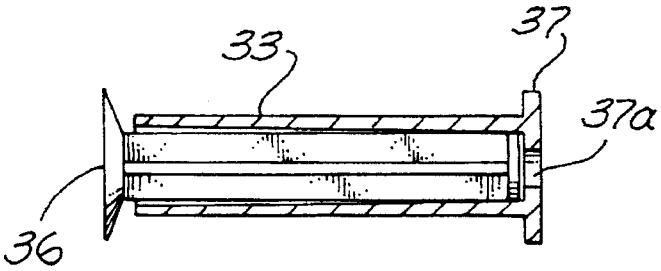
FIG. 6 is a cross-sectional view of a barrel from the magazine of FIG. 4.

The driven clutch plate 28 is attached to a rear sprocket 30, which may be better appreciated with reference to FIG. 3. Sprocket 30 is rigidly attached to a forward sprocket 31 by a shaft 32. The shaft 32 is rotatably supported at its forward end by the frame 11 and at its rearward end within an axial bore of drive shaft 26. The sprockets 30, 31 are forced to rotate by driving engagement of the clutch plates 27, 28, and are employed to advance a belt-like projectile magazine 14 which may be viewed in greater detail in FIG. 4. The magazine comprises a plurality of projectile holding/launching tubes or barrels 33 joined parallel to each other by a support structure 34. The support structure may be integrally molded with the barrels 33 or which may be a separate component including sleeve portions; 35 into which individually formed barrels may be inserted. Each barrel comprises a tube open at the forward end to receive a snugly fitted projectile 36, and having an opening 37*a* (see FIG. 6) at the rearward end to receive pressurized air for ejecting the projectile. The rearward end is further provided with a circular flange 37, which along with guide channels 38 on the frame serves to limit forward motion of the barrel and to facilitate correct alignment of the barrel as it passes through the frame.

As illustrated, projectiles 36 comprise soft plastic darts with suction-cup tips. However, it will be appreciated that the present invention may be practiced with any other kind of air-propelled projectile, such as foam darts, plastic or metal pellets, etc.

For the present embodiment the two ends of the magazine support structure 34 are joined together to form a continuous loop of 24 barrels. To allow the looped magazine to be inserted and removed, a hinged cover 39 swings open about shaft 40. A member 41 of the cover extends into the magazine compartment of frame 11 to form a forward closure for the upper guide channel 38.

The magazine 14 is fed through the gun by the action of the sprockets 30, 31 whose teeth 42 engage the magazine between barrels on either side of support 34. As the barrels pass over the sprockets they rest in the depressions 43 between teeth 42. The sprockets cooperate with the other magazine advancement components 23, 24, 26, 27 & 28 so that at the completion of an advancement step, a barrel is placed in firing alignment with the air nozzle 17.

In summary, the gun 10 is operated by turning (in a counter-clockwise direction with respect to FIG. 1) a hand crank 15 which rotates cam wheel 19. The lobes 20 sequentially engage a hook 21 on the plunger 13 to draw the plunger rearward, thus compressing a firing spring 47 against a shaft 48 fixed to frame 11. Air cylinder 12 is movably carried on the frame 11 to allow some limited motion in the forward and rearward directions. Friction of the piston 16 within the cylinder pulls the cylinder rearward to clear nozzle 17 from the advancement path of the magazine 14. Simultaneously, a member 23 of the plunger actuates a one way ratcheting magazine advancement mechanism 24–32. The advancement mechanism shuttles an exhausted barrel 33 of the magazine 14 out of alignment with air nozzle 17, and brings an adjacent (an preferably loaded) barrel into firing alignment. As the crank 15 rotates further the lobe 20 begins to arc upward until it no longer engages the hook 21. At that point, spring 47 rapidly propels the plunger 13 forward through a firing stroke to compress air within cylinder 12 via piston 16. Air cylinder 12 is moved forwardly by the forces of the pressurized air within and friction with the forwardly moving piston, so that the nozzle 17 engages the rear of the aligned barrel 33. A resilient gasket 17*a* enhances the seal between nozzle 17 and the barrel 33. Compressed air is discharged through nozzle 17 and into the barrel 33 through the previously described opening at its rearward end, whereby the projectile 36 (in this example a soft suction cup dart) is ejected from the gun. Additionally, as the plunger "fires" forwardly, the driving portions 24–27 of the magazine advancement mechanism are forced by plunger member 23 to rotate in a counter-advancement direction, in preparation for the next operational cycle. The remainder of the magazine advancement components including sprockets 30, 31 and the driven clutch plate 28, remain stationary, thereby holding the barrel 33 in firing alignment as the air and projectile are discharged. A spring biased detente of known type (not shown) aids in maintaining alignment of the sprockets and barrel while the driving portions 24–27 reset as previously described.

In practice, the firing spring 47 will typically be somewhat stiff in nature to provide rapid compression of air within cylinder 12. Accordingly, an operator must apply relatively high torque to the crank 15. This may lead to difficulty of operation when the invention is incorporated in guns having traditional form factors such as a pistol or a rifle. In the case of a pistol, one hand must be used to hold the pistol grip, while the other hand must be used to rotate the crank. The application of high torque to the crank will tend to twist the gun both horizontally and vertically about the pistol grip. In the case of a rifle, an operator would typically brace the rear stock of the gun against the shoulder of one arm, the right arm for example, while using the opposite hand (the left hand in this example) to hold the forward part of the gun outwardly. The crank would preferably be located on the rifle somewhere in between these two points of operator support and would be actuated (in this example) by the right hand. While it is feasible to construct and operate the invention in this manner, and applicant has done so, it is somewhat awkward and fatiguing to the crank operating arm. To alleviate these problems the gun 10 is provided, referring to FIG. 2, with a handle 44 and a support 45, in addition to the handle 46 on crank 15. Handle 44 is positioned on the side of the frame, horizontally and generally crosswise to the line of fire, to be grasped by the left hand of an operator, while support 45 is positioned at the rear of the gun, horizontally and crosswise to the line of fire, to be pressed against the torso or hip of the operator. The operator then uses his/her right hand to rotate crank 15 via handle 46. Thus the invention provides a structure which aids the operator in maintaining stability of the gun in a comfortable manner, while turning the crank against the relatively strong force of spring 47. For purposes of minimizing space required for packaging, the side handle 44 is made to be detachable from the frame 11 and support 45 is rotationally mounted on the frame so that it may be swiveled by 90° to a lengthwise vertical orientation. Indexing notches maintain handle 45 in its horizontal position during normal operation. Further in regard to optimized packaging, the crank 15 is hinged perpendicularly to its axis of rotation 18. Thus the crank may be swung outward from the frame through a 180° arc to position handle 46 to overlap the frame. Note that while handle 44 is depicted at one side of a forward portion of the gun, a similar horizontal handle could be effectively located above the same forward portion.

It may be noted that the magazine advancement member 23 may optionally be carried on the frame separately from the plunger 13 and be adapted to be drawn back by rearward travel of the plunger. The plunger and member 23 may be further adapted such that forward travel of the plunger does not itself force member 23 forward; instead an additional spring can be used to provide forward bias to member 23. In the embodiment of FIG. 1, forward motion of the plunger and piston can be slowed by the magazine advancement mechanism as it resets. The advantage of separating member 23 from the plunger is that the plunger and piston are propelled forward essentially unimpeded, for improved air compression, while the; magazine advancement mechanism can be reset at a slower rate by a separate spring. The disadvantage is that more components and assembly requirements are introduced.

Figure 8:
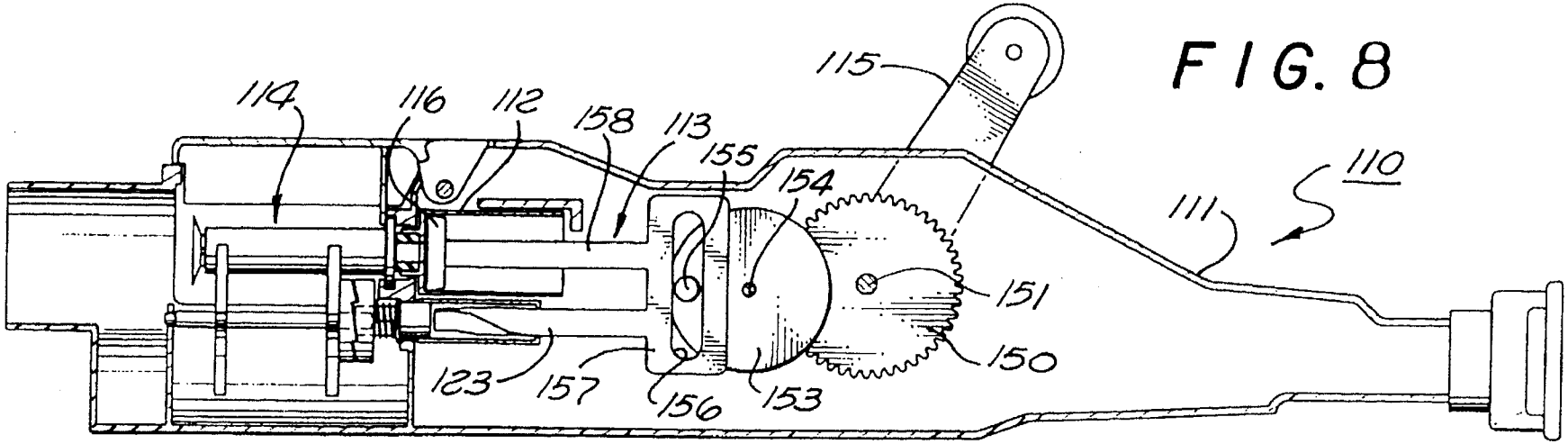
FIG. 8 is a side view in partial cross-section of a second embodiment of a toy air gun according to the present invention.
Figure 9:
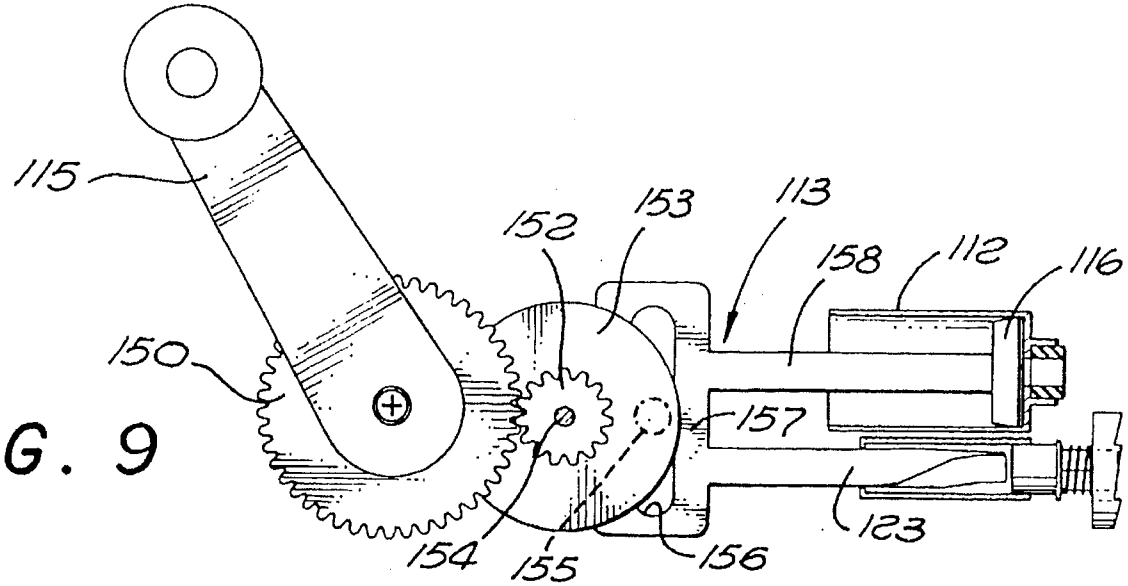
FIG. 9 is an enlarged reverse side view, shown in partial cross-section, of a portion of the components of FIG. 8.

FIGS. 8 and 9 depict another embodiment of the cranking and firing mechanisms. In this construction the crank 115 is rigidly coupled to a large gear 150 which drives a smaller gear 152. Gear 152 is rigidly coupled to a cam wheel 153 which rotates on a shaft 154. A lobe 155 in the form of a short shaft protrudes from the side of cam wheel 153 and engages a slot 156 in a rectangular rear end member 157 of plunger 113. Thus as the crank and gear 150 are rotated about shaft 151, they drive and rotate gear 152 and cam 153. As the cam turns, lobe 155 travels both up and down, and back and forth. The vertical motion of the lobe; is lost in slot 156, while the horizontal motion translates directly to plunger 113. Gear 150 on the crank has 3 times as many teeth as gear 152 on the cam wheel, so the cam wheel and plunger are cycled 3 times for each revolution of the crank. As depicted in the figures, this embodiment provides forward propulsion to the plunger via direct action of the crank and drive train just described whereby the cam pushes the plunger through its firing stroke. However, forward bias may be incorporated to enhance discharge of the air pump by the addition of a spring similar to item 47 in FIG. 1. Further, the gear driven single lobed cam of FIGS. 8 and 9 may be combined with an open hook plunger like that of FIG. 1 (items 13, 21) to yield another embodiment in which the plunger is drawn back and released, to be propelled forward by a spring. The operation and performance of such an embodiment would be generally equivalent to that of the FIG. 1 embodiment except that greater plunger travel can be achieved for the same diameter cam (a single or double lobed cam can be effectively utilized through 180° rotation as opposed to 120° for the three lobed cam of FIG. 1). With a 3:1 gear ratio between crank and cam, the gun still fires three times for each crank revolution. It should be noted that where the term "cam" is used herein, it is intended to be a functional and non-limiting description covering a variety of equivalent eccentric rotating drive devices, including cams and offset crankshafts.

Further embodiments are contemplated in which projectiles are stacked in a magazine and biased by a spring or gravity to successively enter firing alignment with a crank operated air pump. A crank operated mechanism would be employed to then urge the aligned projectile into a single launching barrel and to effect an air seal between the air pump and the barrel, prior to the air pump plunger being moved through a firing stroke. Such a mechanism can be provided in the form of an elongated extension of the air pump nozzle, for example. The nozzle would be moved in conjunction with the plunger so as to retract from the path of a projectile ready for alignment. Once the projectile becomes aligned with the barrel, the nozzle would be moved forward to shove the projectile into the barrel, and to form a seal with the barrel. This forward motion could be achieved either by releasing the nozzle from engagement with the plunger or other component of the cranking mechanism, allowing a secondary spring to then move it forward, or the nozzle could be driven directly by the crank (similar to the directly driven plunger of FIGS. 8 and 9). Forward drive to the nozzle would be out of phase with forward drive to the plunger to allow the projectile and nozzle to become seated with the barrel prior to firing of the plunger. As another option, the crank might further be utilized to provide biasing force to feed the projectiles from such a magazine, in lieu of the aforementioned spring or gravity feeds.

Figure 10:
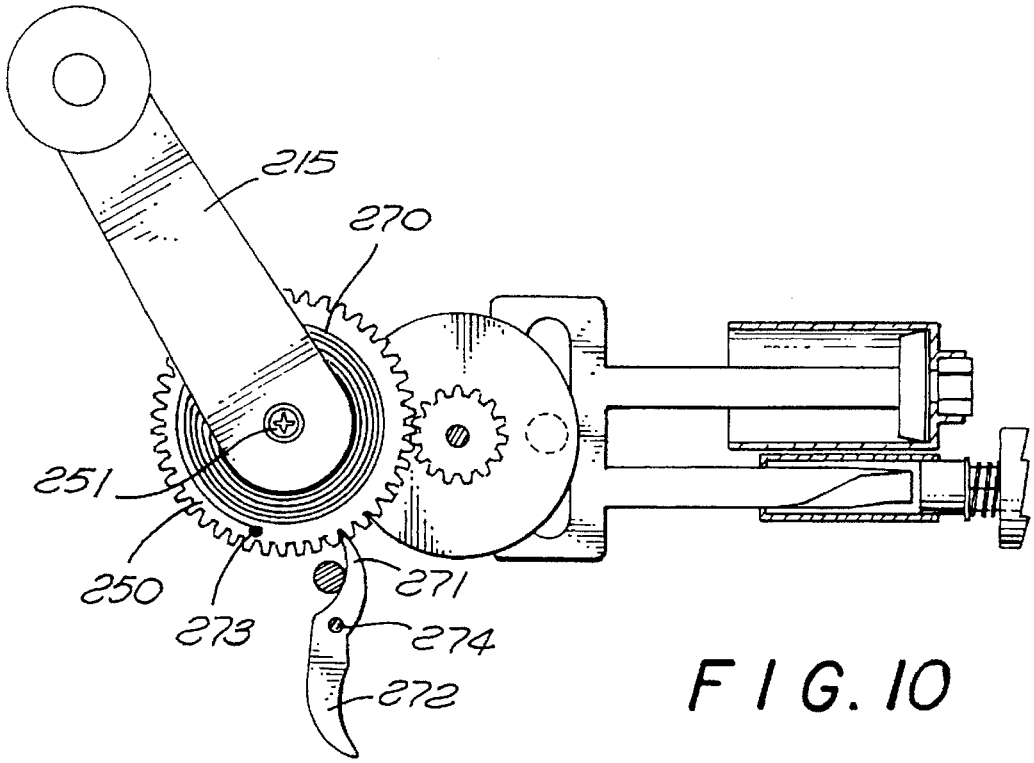
FIG. 10 is a side view of the firing mechanism of a third embodiment of the invention.

The preceding embodiments are similar to one another in that cocking and discharging of the plunger occurs synchronously with rotation of the crank. Other embodiments may be constructed in which, with reference to FIG. 10, the crank 215 is employed to wind and store energy in a torsion spring 270, one end of which is attached to the crank's rotational shaft 251. The other end of the spring will be attached to a cam or cam driving gear similar to those of the previous embodiments. In FIG. 10 the second end of the spring 270 is attached to gear 250 by a pin 273. The crank shaft 251 is in ratcheted engagement with its mounts (not shown) to prevent unwinding of the spring by counter rotation, and the cam is normally precluded from rotation by engagement of a latch. In the figure a latch 271 engages gear 250 to prevent such rotation. A release member in the form of a traditional finger operated trigger 272 is provided to disengage the latch. The trigger is manually pivoted about a shaft 274 to release the gear, thereby allowing the spring to apply its stored energy toward rotating the cam to fire the gun. As in the previously described embodiments rotation of the cam can, through the plunger or other linkage, actuate a magazine advancement mechanism FIGS. 11–16 show an embodiment of an air operated gun 400 generally similar to the gun shown in FIGS. 1–7. The gun 400 has a plastic housing 402 that is constructed to simulate a machine gun. The machine gun 400 preferably has a gun butt 404 located at one end of the housing 402 and a barrel opening 406 located at the opposite end. On one side of the gun 400 is a handle 408 that is mounted to the housing. On the opposite side of the gun 400 is a hand crank 410 which can be rotated relative to the housing 402 by operation of crank handle 412. The hand crank 410 can pivot 180° about a pin 413 that is attached to a base plate 414 as indicated by the arrows. Pivoting the crank 410 about the base 414 reduces the overall width of the gun, thereby facilitating packaging and storage of the gun. The gun 400 also has a cover 416 which pivots about the housing 402 and provides access to a magazine chamber 418.

Figure 12:
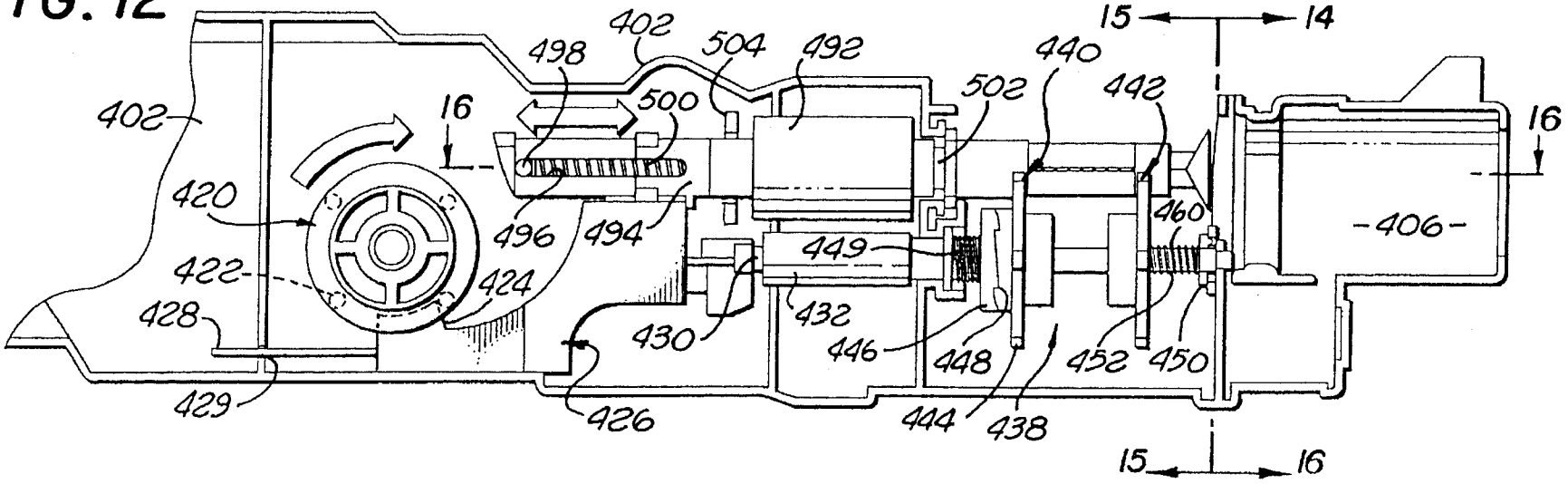
FIG. 12 is a cross-sectional view of the gun taken at line 12—12 of FIG. 11.

As shown in FIG. 12, the hand crank 410 is attached to a firing wheel or cam 420 which has a plurality of pins 422 that engage a hooked surface 424 of a plunger or piston subassembly 426. Rotation of the hand crank 410 causes one of the pins 422 to engage the hooked surface 424 and move the subassembly 426 in a rearward linear direction. The hand crank 410 is rotated until the pin 422 releases from the hooked surface 424, at which point the piston subassembly 426 can move back to its original position. The piston subassembly 426 may have a guide pin 428 that cooperates with a guide hole 429 in the housing 402 to insure a linear movement of the subassembly 426.

Figure 13:
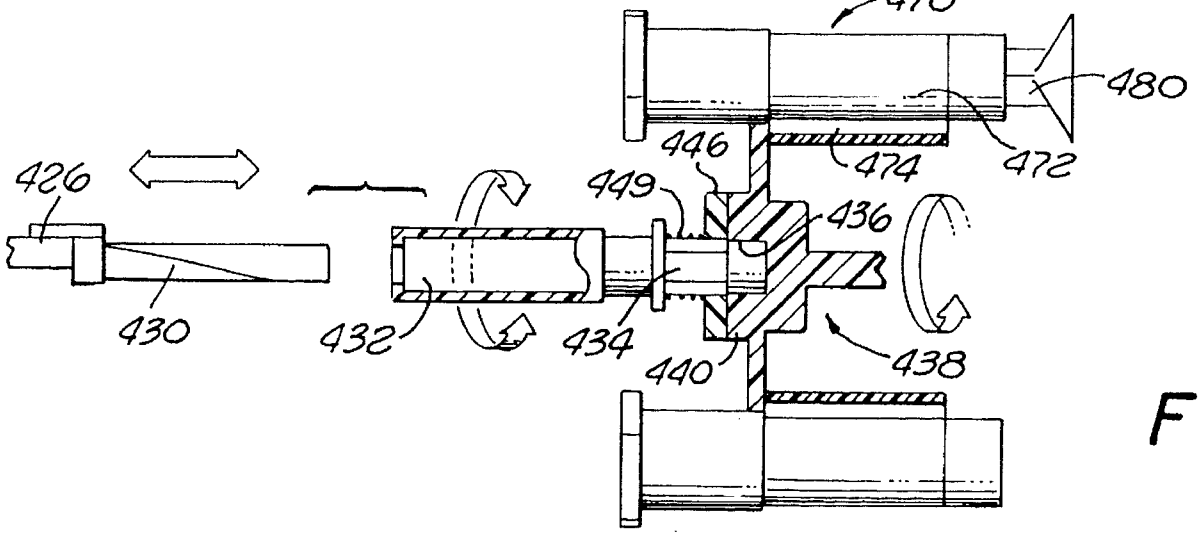
FIG. 13 is an exploded cross-sectional view of a magazine advancement assembly.

As shown in FIG. 13, the piston subassembly 426 includes a member 430 with a twisted or spiral surface that moves within a cylinder 432. The spiral member 430 cooperates with a corresponding inner surface of the cylinder 432 to rotate the cylinder 432 in a first direction when the piston subassembly 426 is moved in a rearward direction by the firing wheel 420.

Referring to FIGS. 12 and 13, the cylinder 432 has an output shaft 434 that extends into a corresponding aperture 436 of a sprocket subassembly 438. The sprocket subassembly 438 has a first sprocket 440 and a second sprocket 442 which each have a plurality of teeth 444. The sprockets 440 and 442 rotate in the first direction when the cylinder 432 is rotated by rearward movement of the piston subassembly 426.

Coupled to the first sprocket 440 is a clutch 446. Both the sprocket 440 and the clutch 446 have cooperating teeth 448 that prevent the sprockets from rotating in a second direction opposite to the first direction of rotation of the cylinder 432. Concentric with the output shaft 434 is a spring 449 which biases the clutch 446 into engagement with the first sprocket 440. When the piston subassembly 426 moves back to the original position, the spiral member 430 will cause a corresponding counter rotation of the cylinder 432. The clutch 446 slips to prevent the sprocket subassembly 438 from undergoing the same counter rotation.

Figure 15:
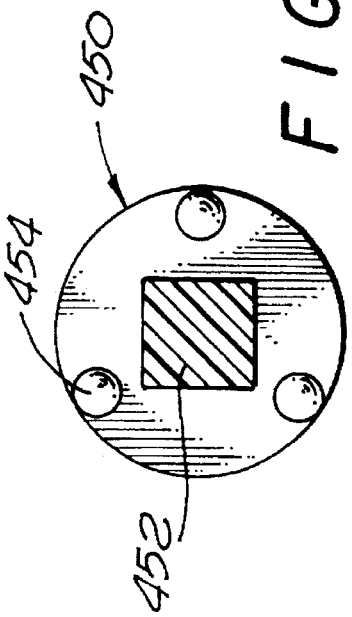
FIG. 15 is a cross-sectional view of the gun taken at line 15—15 of FIG. 12.
Figure 14:
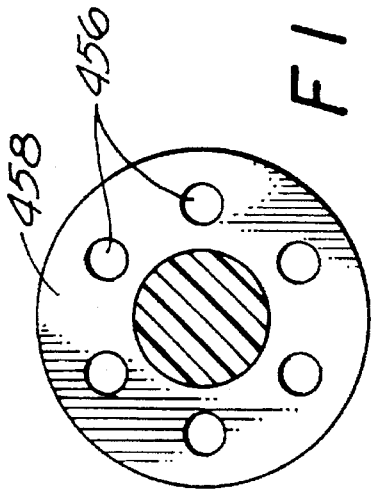
FIG. 14 is a cross-sectional view of the gun taken at line 14—14 of FIG. 12.

The sprocket subassembly 438 has a first detent plate 450 attached to an output shaft 452. As shown in FIGS. 14 and 15, the first detent plate 450 has a number of protrusions 454 that cooperate with corresponding apertures 456 in a second detent plate 458 to maintain the position of the sprockets 440 and 442. When the cylinder 432 rotates, the cylinder 432 also undergoes a slight rearward linear movement which pulls the protrusions 454 of the first detent plate 450 out of the second detent plate 458 to allow rotation of the sprockets 440 and 442. When the piston subassembly 426 moves back to the original position, the output shaft 452 moves in a linear manner to push the protrusions 454 back into the apertures 456. The sprocket subassembly 438 may have a spring 460 that biases the first detent plate 450 into the second detent plate 458.

Figure 11:
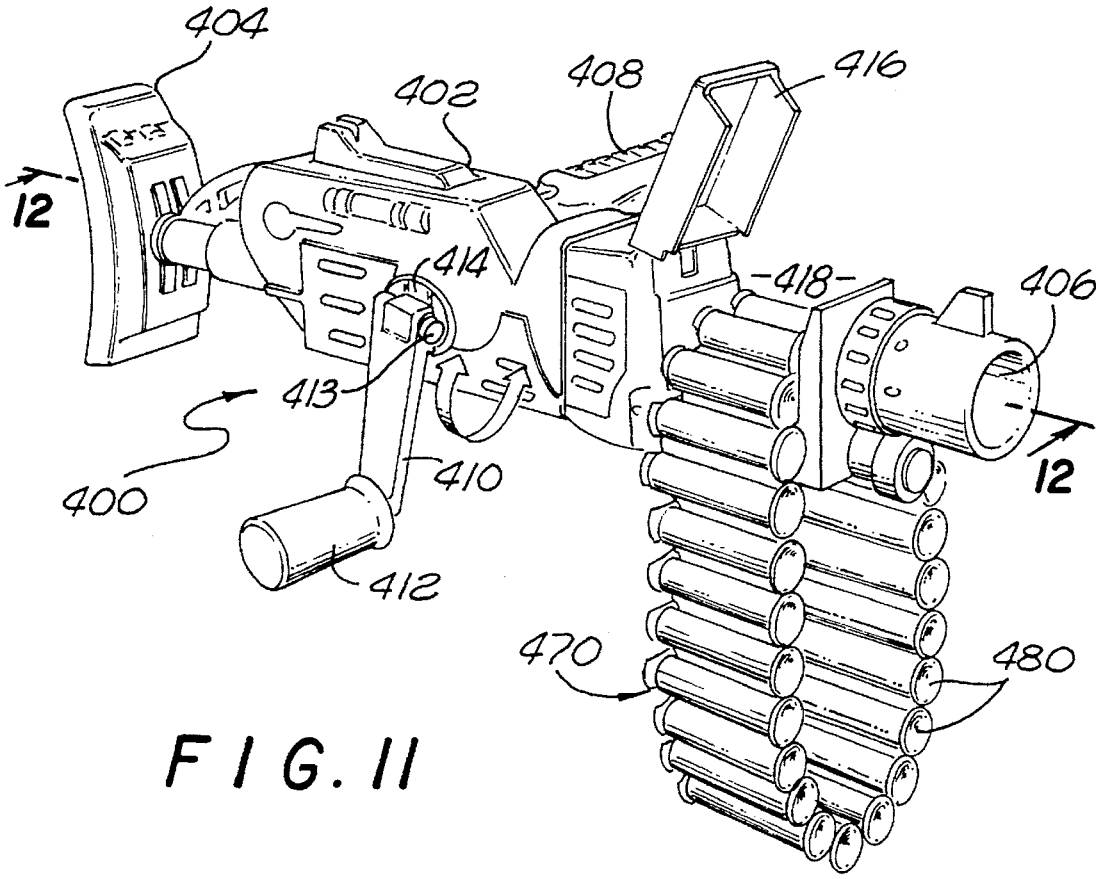
FIG. 11 is a perspective view of another embodiment of a toy gun that simulates a machine gun.
Figure 16:
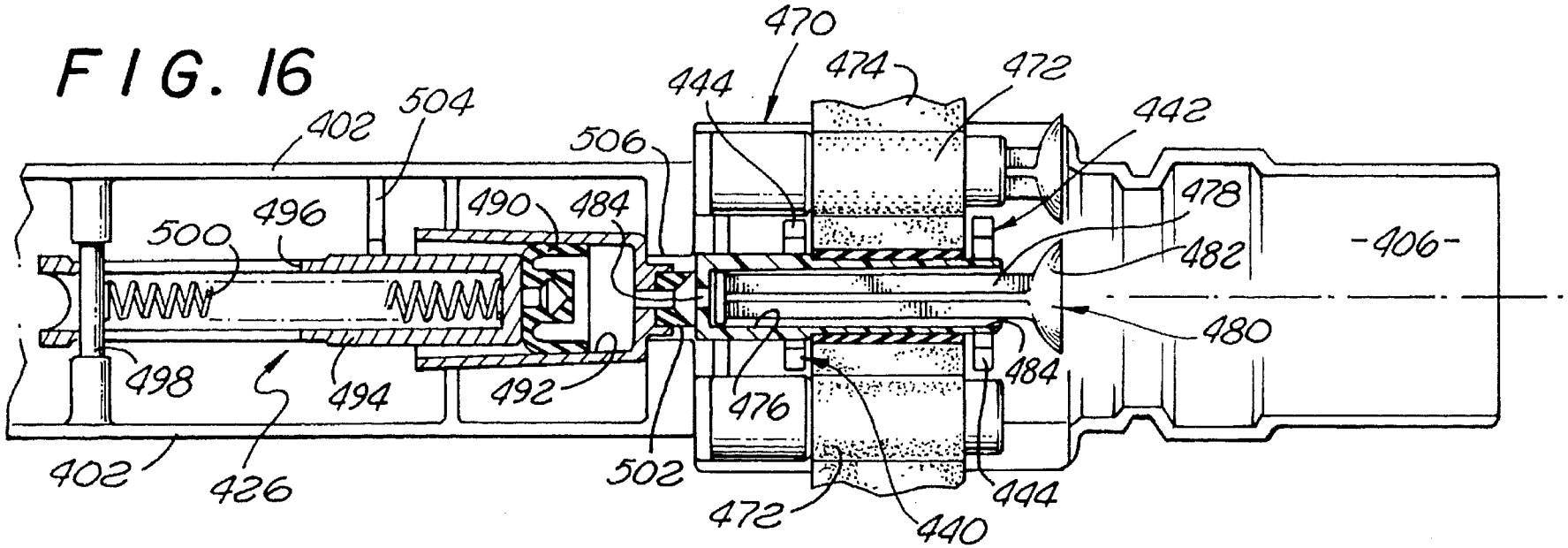
FIG. 16 is a cross-sectional view of the gun taken at line 16—16 of FIG. 12.

As shown in FIGS. 11 and 16, the gun 400 may have a projectile magazine 470 generally resembling an ammunition belt. The magazine 470 has a plurality of projectile holders or barrels 472 that are joined together by link members 474. The barrels 472 and link members 474 can be formed as one integral plastic piece shaped as a continuous loop. Each barrel 472 has an inner chamber 476 that receives the shaft 478 of a dart 480. The darts 480 have suction cups 482 that extend from the magazine 470. The end of each barrel 472 has an opening 484 which allows pressurized air to propel the dart 480 from the magazine 470.

The link members 474 are typically shorter than the length of the barrels 472, so that the magazine 470 can be placed into the magazine chamber 418 of the gun 400 and the teeth 444 of the sprockets 440 and 442 extend between the barrels 472. Rotation of the handle 410 and sprocket subassembly 438 advances the magazine 470 to the next adjacent barrel 472.

Referring to FIGS. 12 and 16, the piston subassembly 426 also has a piston 490 that moves within a cylindrical air chamber 492. The piston 490 is attached to a shaft 494 that has a slot 496. Extending through the slot 496 is a pin 498 that is mounted to the housing 402. The pin 498 impedes the movement of a spring 500 which biases the piston 490 and shaft 494 into the air chamber 492. At the end of the air chamber 492 is a gasket 502 that cooperates with the end of the magazine barrels 472 to provide a seal between the air chamber 492 and the barrels 472. When the piston subassembly 426 moves in a rearward direction, the piston 490 also moves in a corresponding rearward direction within the air chamber 492. Because of the friction between the piston 490 and the air chamber 492, the rearward movement of the subassembly 426 will induce a slight rearward movement of the air chamber 492 relative to the housing 402, so that the gasket 502 is disengaged from the barrel 472. The housing 402 may have a flange 504 that limits the movement of the cylinder 490. Additionally, the housing 402 may have a guide channel 506 that guides the movement of the gasket 502. The spring 500 moves the piston subassembly 426 back to the original position when the firing wheel 420 disengages from the hooked surface 424.

In operation, the cover 416 is opened and the magazine 470 is placed into the magazine chamber 418 of the gun 400. The magazine 470 is placed into the gun so that a barrel 472 is located between a pair of teeth of each sprocket 440 and 442. The hand crank 410 is then rotated so that the firing wheel 420 moves the piston subassembly 426 in a rearward direction. Movement of the subassembly 426 pulls the piston 490 and air chamber 492 in a rearward direction, releasing the gasket 502 from the barrel 472 and increasing the air volume within the air chamber 492. The rearward movement of subassembly 426 also causes the cylinder 432 and sprockets 440 and 442 to rotate and advance the magazine 470 so that the next barrel 472 is aligned with the air chamber 492.

The hand crank 410 is rotated until the firing wheel 420 disengages from the hooked surface 424 and the spring 500 moves the piston subassembly 426 in a forward direction back to its original position. The forward movement of the subassembly 426 causes the piston 490 to pressurize the volume of air within air chamber 492. The pressurized air is exhausted through opening 484 into the barrel chamber 476 and propels the dart 480 from the magazine 470 and through the barrel opening 406 of the gun 400. Continuous rotation of the hand crank 410 will cause a corresponding continuous advancement and firing of darts 480 from the gun 400, wherein the gun simulates an automatic weapon.

It may be observed that the air pumps as described herein can be modified through the addition of inlet and outlet check valves to yield water pumping mechanisms. With the further addition of a water reservoir, the basic crank and pump assemblies may be adapted to create rapid fire water guns.

While particular embodiments of the present invention have been shown and described, those skilled in the art will recognize that changes may be made in form and detail without departing from this invention in its broader aspects and therefore the aim of the claims herein is to cover all such modifications as fall within the true spirit and scope of this invention.

What is claimed is:

1. An air operated projectile launcher comprising:

a frame;

a hand crank operably carried on the frame for rotation about an axis;

an air chamber;

a plunger movably disposed for compressing air within said air chamber;

a discharge port for exhausting compressed air from said air chamber;

a launching barrel for holding a projectile in alignment with said discharge port;

means for forming a substantially airtight seal between said discharge port and said launching barrel;

means for transferring energy from said hand crank to said plunger such that said plunger is caused to compress the air within said air chamber and thereby eject the projectile from the launching barrel;

a projectile magazine having a plurality of projectile launching barrels joined by a supporting structure;

a magazine advancement mechanism for successively placing said barrels into firing alignment with said discharge port;

means for operatively coupling said advancement mechanism with said means for transferring energy such that said magazine is advanced in synchronism with movement of said plunger.

2. An air operated projectile launcher comprising:

a frame;

a hand crank operably carried on the frame for rotation about an axis;

an air chamber;

a plunger movably disposed for compressing air within said air chamber;

a discharge port for exhausting compressed air from said air chamber;

a launching barrel for holding a projectile in alignment with said discharge port;

means for forming a substantially airtight seal between said discharge port and said launching barrel;

means for transferring energy from said hand crank to said plunger such that said plunger is caused to compress the air within said air chamber and thereby eject the projectile from the launching barrel;

wherein said means for transferring energy from the hand crank to the plunger comprises a cocking mechanism to move the plunger from a discharged position to a cocked position and a propulsion mechanism to cause said plunger to move through a firing stroke from said cocked position to said discharged position;

wherein said cocking and propulsion mechanisms comprise a rotatory cam, rotation of said cam being synchronous with actuation of said crank, said cam being in substantially constant engagement with said plunger, whereby rotation of said crank causes said cam to alternately pull and push said plunger for reciprocating travel between said cocked position and said discharged position.

3. An air operated projectile launcher comprising:

a frame;

a hand crank operably carried on the frame for rotation about an axis;

an air chamber;

a plunger movably disposed for compressing air within said air chamber;

a discharge port for exhausting compressed air from said air chamber;

a launching barrel for holding a projectile in alignment with said discharge port;

means for forming a substantially airtight seal between said discharge port and said launching barrel;

means for transferring energy from said hand crank to said plunger such that said plunger is caused to compress the air within said air chamber and thereby eject the projectile from the launching barrel;

wherein said means for transferring energy from the hand crank to the plunger comprises a cocking mechanism to move the plunger from a discharged position to a cocked position and a propulsion mechanism to cause said plunger to move through a firing stroke from said cocked position to said discharged position;

wherein said cocking mechanism comprises:

a torsion spring adapted to be biased by actuation of said crank;

a rotatory cam engageable with said plunger to move said plunger from said discharged position to said cocked position, wherein bias of said torsion spring urges said cam to rotate;

a latch for preventing rotation of said cam;

a latch release mechanism for disengaging said latch to allow rotation of said cam.

4. The invention of claim 3 wherein said cam and said torsion spring are further employed in said propulsion mechanism, said cam being engageable with said plunger to move said plunger from said cocked position to said discharged position.

5. An air operated projectile launcher comprising:

a frame;

a hand crank operably carried on the frame for rotation about an axis;

an air chamber;

a plunger movably disposed for compressing air within said air chamber;

a discharge port for exhausting compressed air from said air chamber;

a launching barrel for holding a projectile in alignment with said discharge port;

means for forming a substantially airtight seal between said discharge port and said launching barrel;

means for transferring energy from said hand crank to said plunger such that said plunger is caused to compress the air within said air chamber and thereby eject the projectile from the launching barrel;

wherein said means for transferring energy from the hand crank to the plunger comprises a cocking mechanism to move the plunger from a discharged position to a cocked position and a propulsion mechanism to cause said plunger to move through a firing stroke from said cocked position to said discharged position;

a projectile magazine having a plurality of projectile launching barrels joined by a supporting structure;

a magazine advancement mechanism for successively placing said barrels into firing alignment with said discharge port;

means for operatively coupling said advancement mechanism with said cocking and propulsion mechanisms such that said magazine is advanced in synchronism with movement of said plunger.

6. The invention of claim 5 wherein actuation of said cocking and propulsion mechanisms is synchronous with rotation of said crank, and wherein said propulsion mechanism comprises a spring which biases said plunger from said cocked position toward said discharged position.

7. The invention of claim 6 further comprising a cam rotationally driven by said crank, said cam being engageable with said plunger for drawing said plunger toward said cocked position, said cam adapted to release said plunger at said cocked position whereby said spring can propel said plunger through a firing stroke.

8. The invention of claim 7 wherein said plunger comprises a magazine advancement member which engages and actuates said magazine advancement mechanism as said plunger reciprocates between said discharged and cocked positions.

9. The invention of claim 8 wherein said air chamber comprises an elongated hollow cylinder;

movement of said plunger being generally lengthwise with respect to said cylinder;

said magazine advancement member of said plunger comprising an elongated portion extending generally lengthwise along the outside of said cylinder;

said magazine advancing member operationally engaging said magazine advancement mechanism as said plunger is moved from said discharged position to said cocked position.

10. The invention of claim 9 wherein said elongated portion of said magazine advancement member comprises a segment having a noncircular cross-section;

said segment being twisted about the central longitudinal axis of said segment so that cross-sections taken along the length of said segment will appear rotated with respect to one another;

said magazine advancement mechanism comprising an interface member for engagement with said twisted segment;

said interface member being carried for rotation about an axis and comprising an opening centered about said axis;

said opening being generally complementary in shape to said cross-section of said twisted segment;

said twisted segment being slidingly received within said opening whereby reciprocative travel of said segment urges said interface member to rotate so as to follow the degree of twist of said segment at its point of contact with said interface member;

said interface member being coupled to said magazine through a unidirectional rotary ratchet mechanism whereby rotation of said interface member in one direction causes said magazine to advance and rotation of said interface member in the other direction does not cause said magazine to move.

11. The invention of claim 10 wherein said magazine advancement mechanism comprises at least one sprocket driven to rotate in one direction only by said rotary ratchet mechanism;

said sprocket being engageable with said barrels of said magazine to successively move said barrels into alignment with said discharge port to thereby effect advancement of said magazine.

12. The invention of claim 5 wherein said cocking and propulsion mechanisms comprise a rotatory cam, rotation of said cam being synchronous with actuation of said crank, said cam being in substantially constant engagement with said plunger, whereby rotation of said crank causes said cam to alternately pull and push said plunger for reciprocating travel between said cocked position and said discharged position.

13. The invention of claim 12 wherein said plunger comprises a magazine advancement member which engages and actuates said magazine advancement mechanism as said plunger reciprocates between said discharged and cocked positions.

14. The invention of claim 13 wherein said air chamber comprises an elongated hollow cylinder;

movement of said plunger being generally lengthwise with respect to said cylinder;

said magazine advancement member of said plunger comprising an elongated portion extending generally lengthwise along the outside of said cylinder;

said magazine advancing member operationally engaging said magazine advancement mechanism as said plunger is moved from said discharged position to said cocked position.

15. The invention of claim 14 wherein said elongated portion of said magazine advancement member comprises a segment having a noncircular cross-section;

said segment being twisted about the central longitudinal axis of said segment so that cross-sections taken along the length of said segment will appear rotated with respect to one another;

said magazine advancement mechanism comprising an interface member for engagement with said twisted segment;

said interface member being carried for rotation about an axis and comprising an opening centered about said axis;

said opening being generally complementary in shape to said cross-section of said twisted segment;

said twisted segment being slidingly received within said opening whereby reciprocative travel of said segment urges said interface member to rotate so as to follow the degree of twist of said segment at its point of contact with said interface member;

said interface member being coupled to said magazine through a unidirectional rotary ratchet mechanism whereby rotation of said interface member in one direction causes said magazine to advance and rotation of said interface member in the other direction does not cause said magazine to move.

16. The invention of claim 15 wherein said magazine advancement mechanism comprises at least one sprocket driven to rotate in one direction only by said rotary ratchet mechanism;

said sprocket being engageable with said barrels of said magazine to successively move said barrels into alignment with said discharge port to thereby effect advancement of said magazine.

17. The invention claim 5 wherein said plunger cocking mechanism comprises:

a torsion spring adapted to be biased by actuation of said crank;

a rotatory cam engageable with said plunger to move said plunger from said discharged position to said cocked position, wherein bias of said torsion spring urges said cam to rotate;

a latch for preventing rotation of said cam;

a latch release mechanism for disengaging said latch to allow rotation of said cam.

18. The invention of claim 17 wherein said plunger comprises a magazine advancement member which engages and actuates said magazine advancement mechanism as said plunger reciprocates between said discharged and cocked positions.

19. The invention of claim 18 wherein said air chamber comprises an elongated hollow cylinder;

movement of said plunger being generally lengthwise with respect to said cylinder;

said magazine advancement member of said plunger comprising an elongated portion extending generally lengthwise along the outside of said cylinder;

said magazine advancing member operationally engaging said magazine advancement mechanism as said plunger is moved from said discharged position to said cocked position.

20. The invention of claim 19 wherein said elongated portion of said magazine advancement member comprises a segment having a noncircular cross-section;

said segment being twisted about the central longitudinal axis of said segment so that cross-sections taken along the length of said segment will appear rotated with respect to one another;

said magazine advancement mechanism comprising an interface member for engagement with said twisted segment;

said interface member being carried for rotation about an axis and comprising an opening centered about said axis;

said opening being generally complementary in shape to said cross-section of said twisted segment;

said twisted segment being slidingly received within said opening whereby reciprocative travel of said segment urges said interface member to rotate so as to follow the degree of twist of said segment at its point of contact with said interface member;

said interface member being coupled to said magazine through a unidirectional rotary ratchet mechanism whereby rotation of said interface member in one direction causes said magazine to advance and rotation of said interface member in the other direction does not cause said magazine to move.

21. The invention of claim 20 wherein said magazine advancement mechanism comprises at least one sprocket driven to rotate in one direction only by said rotary ratchet mechanism;

said sprocket being engageable with said barrels of said magazine to successively move said barrels into alignment with said discharge port to thereby effect advancement of said magazine.

22. The invention of claim 17 wherein said cam and said torsion spring are further employed in said propulsion mechanism, said cam being engageable with said plunger to move said plunger from said cocked position to said discharged position.

23. An air operated projectile launcher with projectiles, comprising:

a frame;

a projectile magazine detachably coupled to said frame, said projectile magazine having a plurality of barrels;

a plurality of projectiles carried by said barrels;

means for providing a volume of pressurized air to said barrels to launch said projectiles from said barrels;

a nozzle coupled to said means for providing pressurized air, said nozzle movable from a retracted position to an extended position such that said means for providing pressurized air is sealed to one of said barrels when said nozzle is in said extended position;

magazine advancement means for moving and aligning one of said barrels with said means for providing pressurized air; and a crank, rotation of which causes one of said barrels to move into alignment with said means for providing pressurized air and to cause said means for providing pressurized air to eject said projectile from said aligned barrel.

24. The launcher as recited in claim 23, wherein said frame is shaped as a machine gun.

25. The launcher as recited in claim 23, wherein said means for providing pressurized air includes a piston operatively connected to an air chamber such that said piston can move between a cocked position and a discharged position, said piston being attached to a piston subassembly that moves when said crank is rotated.

26. The launcher as recited in claim 25, wherein said means for providing pressurized air includes a spring that biases said piston to the discharged position.

27. The launcher as recited in claim 23, wherein said projectile magazine is formed as a continuous loop.

28. The launcher as recited in claim 23, wherein each of said barrels has an opening engaged by said nozzle when in the extended position for allowing the pressurized air to enter said barrel.

29. The launcher as recited in claim 23, wherein said magazine advancement means comprises a sprocket that engages and advances said projectile magazine.

30. The launcher as recited in claim 29, wherein said sprocket is coupled to an advancement assembly which rotates said sprocket when said crank is rotated.

31. The launcher as recited in claim 29, wherein said means for providing pressurized air comprises an air piston assembly and wherein said magazine advancement means includes a first member coupled to the air piston assembly that moves in a linear manner relative to a cooperating second member, wherein linear movement of said first member induces a rotation of said second member, said second member being coupled to said sprocket.

32. The launcher as recited in claim 31, wherein said second member is coupled to said sprocket by a clutch that allows rotation of said sprocket in only one direction.

33. The launcher as recited in claim 31, wherein said first member comprises a spiral surface and said second member comprises a cylinder with an internal surface in cooperating engagement with said spiral surface.

* * * * *

UNITED STATES PATENT AND TRADEMARK OFFICE

CERTIFICATE OF CORRECTION

PATENT NO. : 5,660,159

DATED : August 26, 1997

INVENTOR(S) : Clayton

It is certified that error appears in the above-identified patent and that said Letters Patent is hereby corrected as shown below:

In column 4 at line 42, please delete " portions; " and insert -- portions --.

In column 5 at line 41, please delete " detente " and insert -- détente --.

In column 6 at line 34, please delete " the; " and insert -- the --.

Signed and Sealed this

Second Day of March, 1999

*Attest:*

Q. TODD DICKINSON

*Attesting Officer*

*Acting Commissioner of Patents and Trademarks*